US009885536B2

(12) United States Patent
Marshall

(10) Patent No.: US 9,885,536 B2
(45) Date of Patent: Feb. 6, 2018

(54) MAGNETICALLY-CHAMBERED FULLY AUTOMATIC AIR GUN

(71) Applicant: James Nicholas Marshall, Vista, CA (US)

(72) Inventor: James Nicholas Marshall, Vista, CA (US)

( * ) Notice: Subject to any disclaimer, the term of this patent is extended or adjusted under 35 U.S.C. 154(b) by 597 days.

(21) Appl. No.: 14/449,550

(22) Filed: Aug. 1, 2014

(65) Prior Publication Data

US 2016/0363413 A1 Dec. 15, 2016

(51) Int. Cl.

| | |
|---|---|
| ***F41B 11/57*** | (2013.01) |
| ***F41B 11/52*** | (2013.01) |
| ***F41B 11/55*** | (2013.01) |
| ***F41B 11/721*** | (2013.01) |
| ***F41B 11/50*** | (2013.01) |
| ***F41B 11/62*** | (2013.01) |

(52) U.S. Cl.

CPC ..... *F41B 11/57* (2013.01); *F41B 11/50* (2013.01); *F41B 11/52* (2013.01); *F41B 11/55* (2013.01); *F41B 11/62* (2013.01); *F41B 11/721* (2013.01)

(58) Field of Classification Search

CPC ..... F41B 11/50; F41B 11/52; F41B 11/53; F41B 11/54; F41B 11/55; F41B 11/57; F41B 11/72; F41B 11/721; F41B 11/723

USPC ... 124/56, 60, 70, 71, 72, 73, 74, 75, 76, 77

See application file for complete search history.

(56) References Cited

U.S. PATENT DOCUMENTS 2,673,557 A 3/1954 Sherman et al.
3,142,294 A * 7/1964 Baldwin, Jr. ..... F41B 7/006 124/27
4,002,156 A * 1/1977 Fischer ..... F41B 11/51 124/67
4,108,272 A 8/1978 Paitson et al.
4,402,382 A 9/1983 Mollere
4,944,212 A 7/1990 Hilal
5,349,938 A 9/1994 Farrell
5,361,746 A * 11/1994 Szente ..... F41B 11/55 124/49
5,363,834 A * 11/1994 Stuchlik ..... F41B 11/723 124/69
5,383,442 A * 1/1995 Tippmann ..... F41A 29/02 124/73
5,763,812 A 6/1998 Collins
(Continued)

OTHER PUBLICATIONS

Diagram from webpage, www.shootingstargames.com, "See Our Laser Guns" link, accessed Apr. 21, 2014, author unknown.

*Primary Examiner* — Bret Hayes
(74) *Attorney, Agent, or Firm* — Birch, Stewart, Kolasch & Birch, LLP

(57) ABSTRACT

In an open chamber air gun, a round is gravity fed or magnetically fed into the open chamber and falls into the magnetic flux lines of a magnet disposed at the chamber. Due to the magnet, the round is pulled securely into the chamber and then remains momentarily held in place, blocking much of the air behind it and thus increasing the air pressure driving it. When the round moves down the barrel from the breech toward the muzzle, it quickly leaves the vicinity of the magnet and the magnetic drag ceases, after which the air pressure is free to drive the round to full velocity. High rates of fire and muzzle velocities are achieved with moderate air pressure and an action with no moving parts.

14 Claims, 4 Drawing Sheets

(56) References Cited

U.S. PATENT DOCUMENTS

| | | | | |
|---|---|---|---|---|
| 6,152,125 | A * | 11/2000 | Piper | F41A 9/36 124/59 |
| 6,302,092 | B1 | 10/2001 | Juan | |
| 6,439,217 | B1 | 8/2002 | Shih | |
| 6,618,975 | B1 | 9/2003 | Shih | |
| 6,644,293 | B2 | 11/2003 | Jong | |
| 7,017,569 | B2 | 3/2006 | Jong | |
| 7,607,424 | B2 | 10/2009 | Monks | |
| 7,762,248 | B1 | 7/2010 | Squire | |
| 8,006,680 | B1 | 8/2011 | Squire | |
| 8,402,959 | B1 | 3/2013 | Nungester | |
| 8,578,922 | B1 | 11/2013 | Granger | |
| 2004/0237952 | A1* | 12/2004 | Maeda | F41B 11/62 124/56 |
| 2006/0027085 | A1 | 2/2006 | Pearlstein et al. | |
| 2012/0132187 | A1* | 5/2012 | Murray | F41A 9/37 124/77 |
| 2014/0000578 | A1 | 1/2014 | Huang et al. | |

* cited by examiner

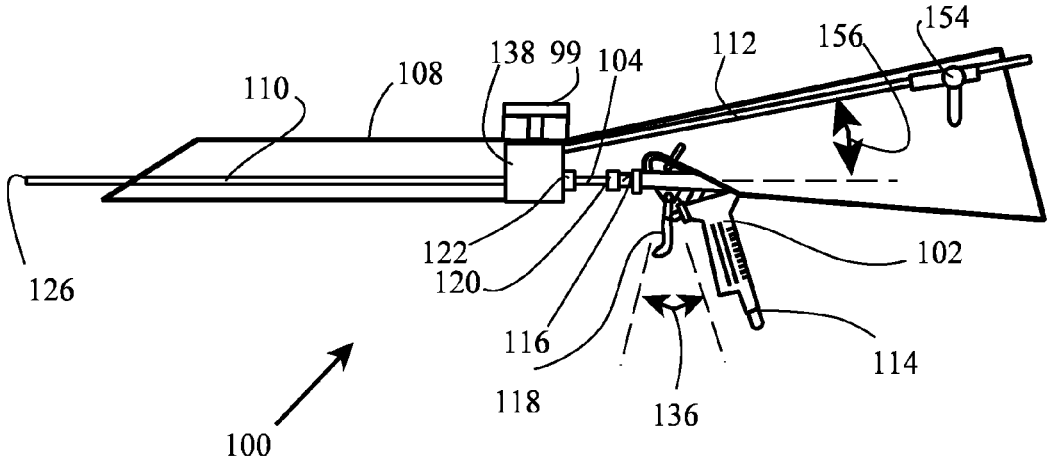
Figure 1
Figure 2a
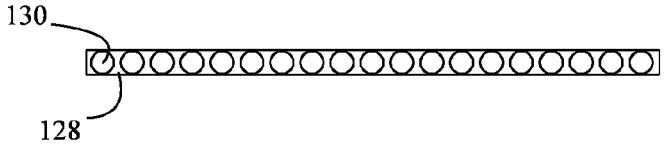
Figure 2b
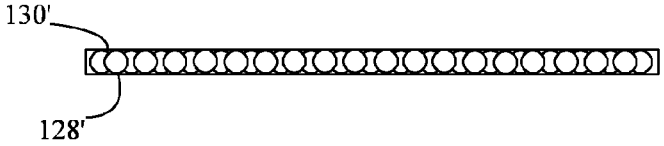

Figure 4
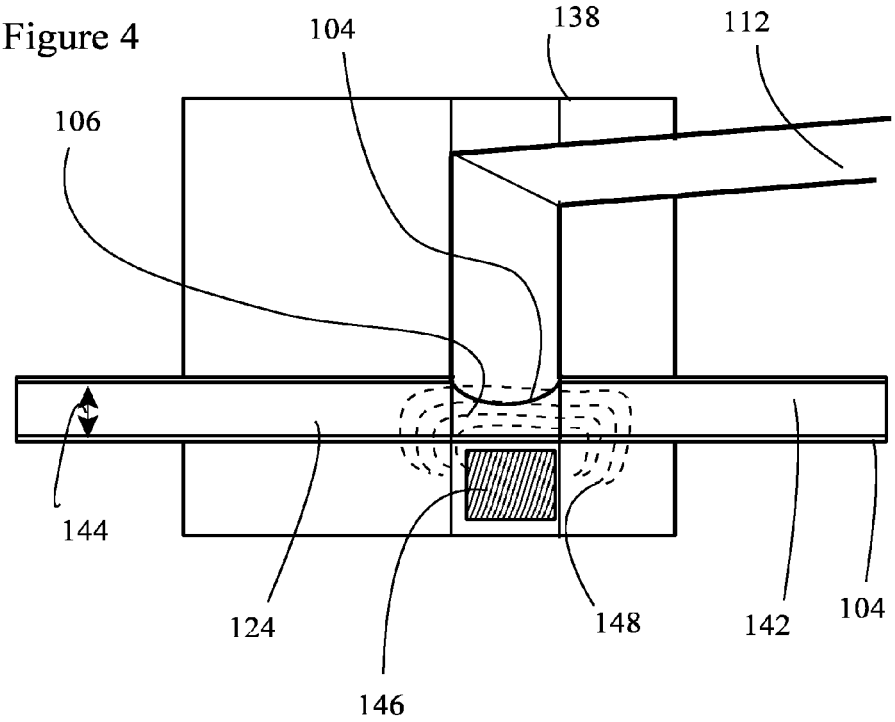
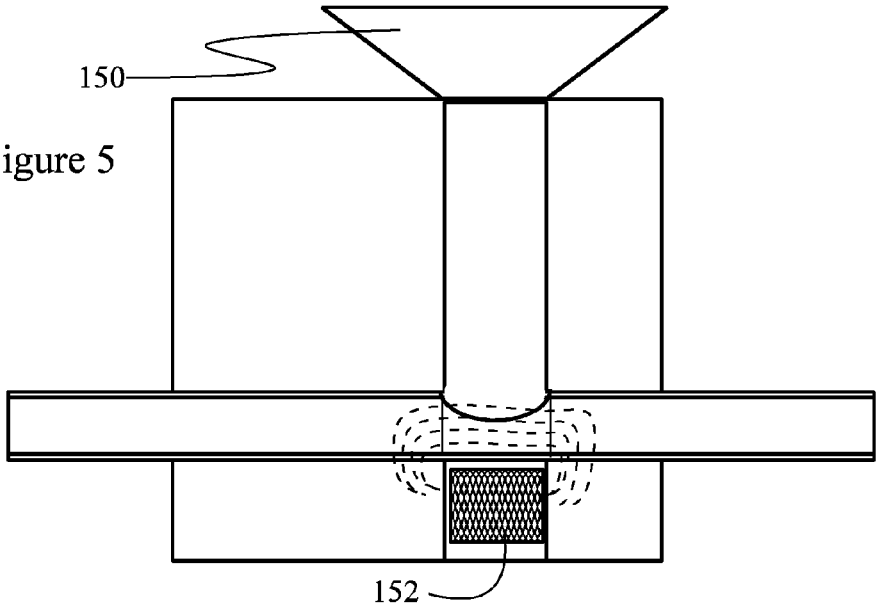
Figure 5

MAGNETICALLY-CHAMBERED FULLY AUTOMATIC AIR GUN

RELATED APPLICATION(S)

N/A

FIELD OF THE INVENTION

This invention relates generally to mechanical guns such as are found in class 124, and specifically to rapid fire fluid propelled mechanical guns such as are found in subclass 72 thereof.

BACKGROUND

It is well known that simplicity in the mechanical action of a weapon is extremely important. Stories of soldiers dying because their rifles jammed in the mud are notorious, as are the amounts of time which sporting enthusiasts must spend maintaining their weapons. Thus, it is frequently true that a weapon is considered an advance over previous models because it simplifies the action.

Increasingly the cost and trouble of maintaining weapons, both sporting and military, outweighs the actual cost of production. This is yet another reason for seeking simplicity in the action of a weapon.

In addition, air guns present some notable advantages over gunpowder weapons, however, air guns also tend to suffer from the problem of overly complex actions. For example, a typical low end lever-action air gun might generate a muzzle velocity of only 275 FPS (85 m/s), and require half a minute to pump up, even though it has numerous moving parts such as a piston, the lever, the lever arm, block, and so on.

One example of a rapid fire air gun is that manufactured by Shooting Star (www.shootingstargames.com), the action of which is pictured in PRIOR ART FIGS. 6 and 7. It will immediately be seen that this design features a large number of moving parts, detents, feeds and so on. FIGS. 6 and 7 are in fact to be found on that company website, for the use of customers who must take the weapon apart and attempt to figure out which part is broken, which part number corresponds to that part, and then order the part. Notably, the gun appears to be entirely non-magnetic. The part numbers of PRIOR ART FIGS. 6 and 7 are Shooting Star Game company part numbers and are NOT reference numerals of the present invention and are provided for illustrative purposes only.

Various weapons have used magnetic forces in their actions in various manners. However, these weapons all have more or less traditional actions, which use magnetism merely as an adjunct to some form of mechanical action. It does not appear that any reference patent discloses use of a magnet to replace the action, much less use of the magnet in the configuration of the present invention.

It would be preferable to provide an air gun with as few moving parts as possible in the action, preferably none at all. It would further be preferable to provide an air gun having the ability to fire at full automatic, and yet generate, in embodiments, muzzle velocities similar to those of gunpowder weapons.

SUMMARY OF THE INVENTION

The present invention teaches an air gun which achieves high rates of fully automatic fire with virtually no "action"

as the term is normally used in reference to arms. In particular, there is a fully open chamber which would normally be called "open breech", but in fact there is no breech block, no firing pin, no coil nor leaf spring and so on and so forth. There is in fact no moving part for the actual action of the gun, the only necessarily moving parts are the trigger and the air valves. This of course presents enormous advantages in terms of ease of manufacture, ease of use, ease of cleaning, cost reduction and so on.

This invention is also capable of enormous rates of fire. In one embodiment having a 90 angle feed tube angle and using small caliber ammunition, the air gun of the invention was able to achieve a rate of fire of approximately 160 rounds per second, that is, about 9600 rounds per minute.

The present invention teaches that a magnet can provide sufficient control over a magnetically responsive spherical round to both chamber the round without moving parts and also to retain the round in place while air pressure builds behind it, thus providing a momentary forcible cessation of the motion of the round. In use, the round is gravity fed or magnetically fed (or in the preferred embodiment of the invention, a combination of both) into the open chamber from a feed. The round falls into the magnetic flux lines (magnetic influence) of the magnet disposed at the chamber (note that this is not a "firing" chamber as no "firing" occurs in an air gun). The dwindling air pressure from the round immediately before could conceivably under adverse conditions of pressure and timing be sufficient to cause the new round to roll down the barrel and dribble harmlessly from the muzzle. However, due to the magnet, the round is pulled securely into the chamber and then remains momentarily held in place, blocking much of the air behind it and thus increasing the air pressure driving it. When the round finally begins to move down the barrel from the breech toward the muzzle, it quickly leaves the vicinity of the magnet and the magnetic drag ceases, after which the air pressure is free to drive the round to full velocity.

17 Caliber rounds from the weapon have been tested and have showed a dispersion pattern of approximately 1.5" (38 mm) at 25 feet range (7.5 m). The power which can be generated by this means is demonstrated by the fact that a rate of fire of approximately 1500 to 1800 rounds per minute can be fired with the entirely open chamber and a moderate air pressure: an air supply of approximately 95 to 120 psi (655 to 827 KPa). Note that .172 steel ball bearings or BBs were tested, not .177 shot, although .177 and larger sizes can easily be accommodated by changing the barrel, chamber and feed and so on. In addition, since the barrel caliber is sized to be as much as 25% greater than the round caliber a single weapon can actually accommodate a range of ammunition calibers.

Even more impressively these rounds reach a muzzle velocity of approximately 365 FPS (110 m/s) in fully automatic fire. For comparison, the US military officer's sidearm for approximately half a century was the Browning M1911 45 caliber semi-automatic, which generated about 850 FPS (255 m/s).

Thus the weapon can be used in either a lethal or non-lethal configuration: with reductions in air pressure or reductions in the magnetic attraction of the ammunition, (for example, by using small amounts of iron in a liquid pellet such as pepper or paint) other uses such as non-lethal ship defense, sporting applications and so on can be allowed.

Thus it is one embodiment, aspect, advantage and objective of the present invention, in addition to those discussed previously, to provide an air gun for use with a plurality of rounds of magnetically responsive spherical ammunition having a caliber, the air gun comprising: a source of pressurized air, the source of pressurized air pneumatically connected to a first end of a hand grip, the hand grip having a first passageway therethrough from the first end of the hand grip to a second end of the hand grip, the second end of the hand grip pneumatically connected to a first end of an air feed line, the air feed line having a second passageway therethrough from the the first end of the air feed line to a second end of the air feed line, the second end of the air feed line pneumatically connected to a chamber, the chamber having a breech end of a gun barrel pneumatically connected thereto, the gun barrel having a muzzle, the gun barrel, the chamber, and the first and second passageways forming a continuous air flow conduit for air from the source of pressurized air to flow to and exit from the muzzle, the breech end of the gun barrel, the chamber, and the second end of the air feed line being magnetically non-responsive materials, the chamber further having a magnet disposed at the chamber, with the magnetic influence of the magnet exerting magnetic force within the chamber, the chamber having an aperture on a top side of the chamber, the chamber yet further having a gravity feed thereto, the gravity feed disposed above the aperture, the aperture, the gun barrel, and the chamber having respective inner diameters larger than such caliber, whereby when a first one of such plurality of rounds of magnetically responsive spherical ammunition leaves the gravity feed, it falls into the chamber and into the magnetic influence of the magnet, the magnet tending to hold such first round in place in the chamber until the air pressure expels such first round from the chamber into the barrel and thence from the muzzle.

Thus it is one embodiment, aspect, advantage and objective of the present invention, in addition to those discussed previously, to provide an air gun wherein the hand grip further comprises: a trigger, the trigger attached to a valve mechanism within the first passageway, the valve mechanism and trigger having a first open position in which air from the source of pressurized air may flow through the first passageway and having a second closed position in which air from the source of pressurized air may not flow through the first passageway, the trigger further being biased into the second closed position when at rest, whereby when the trigger is pulled, the valve mechanism opens, allowing pressurized air flow through the gun from the source of pressurized air to the muzzle.

Thus it is one embodiment, aspect, advantage and objective of the present invention, in addition to those discussed previously, to provide an air gun wherein the gravity feed further comprises: a container holding a plurality of such rounds of magnetically responsive spherical ammunition, whereby when such first round is expelled by the air pressure from the chamber, a second one of such plurality of rounds of magnetically responsive spherical ammunition leaves the gravity feed and falls into the chamber and into the magnetic influence of the magnet, the magnet then tending to hold such second round in place in the chamber until the air pressure expels such second round from the chamber into the barrel and thence from the muzzle.

Thus it is one embodiment, aspect, advantage and objective of the present invention, in addition to those discussed previously, to provide an air gun wherein the container further comprises one member selected from the group consisting of: a feed tube, a hopper, a magazine, and combinations thereof.

Thus it is one embodiment, aspect, advantage and objective of the present invention, in addition to those discussed previously, to provide an air gun, wherein the container comprises the feed tube, and the feed tube enters the chamber at a first angle above the horizontal, the first angle preferably being in the range from 0 to 90 degrees.

Thus it is one embodiment, aspect, advantage and objective of the present invention, in addition to those discussed previously, to provide an air gun wherein the magnet is disposed below the chamber.

Thus it is one embodiment, aspect, advantage and objective of the present invention, in addition to those discussed previously, to provide an air gun wherein the magnet is one member selected from the group consisting of: a ferrous magnet, a rare-earth magnet, an electromagnet, and combinations thereof.

Thus it is one embodiment, aspect, advantage and objective of the present invention, in addition to those discussed previously, to provide an air gun further comprising: a frame, the frame having a first frame member supporting the gun barrel, the chamber, and the air feed line, the first frame member secured to the hand grip.

Thus it is one embodiment, aspect, advantage and objective of the present invention, in addition to those discussed previously, to provide an air gun, wherein the hand grip further comprises a gun breech.

Thus it is one embodiment, aspect, advantage and objective of the present invention, in addition to those discussed previously, to provide an air gun wherein such plurality of rounds of magnetically responsive spherical ammunition further comprise one member selected from the group consisting of: steel ball bearings, shot, BB ammunition, and combinations thereof.

Thus it is one embodiment, aspect, advantage and objective of the present invention, in addition to those discussed previously, to provide an air gun wherein such caliber is .172" (4.37 mm).

Thus it is one embodiment, aspect, advantage and objective of the present invention, in addition to those discussed previously, to provide an air gun wherein such gun barrel has an inner diameter of 0.187" (4.75 mm).

Thus it is one embodiment, aspect, advantage and objective of the present invention, in addition to those discussed previously, to provide an air gun wherein such source of pressurized air provides the pressurized air in a range from 95 to 120 psi (655 KPa to 827 KPa).

Thus it is one embodiment, aspect, advantage and objective of the present invention, in addition to those discussed previously, to provide an air gun wherein such caliber is one member selected from the group consisting of: 9.6 mm, 8 mm, and 5.5 mm.

Thus it is one embodiment, aspect, advantage and objective of the present invention, in addition to those discussed previously, to provide an air gun wherein the container holds such first and second rounds in a staggered arrangement.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 1 is a side view of a first embodiment of the invention, showing overall configuration and externally visible parts.

FIG. 2*a* is a cross-sectional side view of a straight magazine, showing rounds therein.

FIG. 2*b* is a cross-sectional side view of a staggered round magazine, showing rounds therein.

FIG. 4 is a cross-sectionals side view of a chamber of the first embodiment of the invention, showing details thereof.

FIG. 5 is a cross-sectional side view of a chamber of a second embodiment of the invention, showing details thereof.

INDEX TO THE REFERENCE NUMERALS

Figure 3:
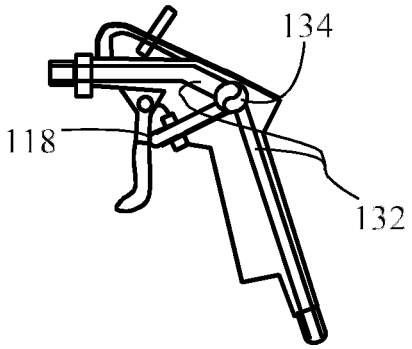
FIG. 3 is a cross-sectional side view of a hand grip of the first embodiment of the invention, showing the first passageway and valve mechanism.
Figure 6:
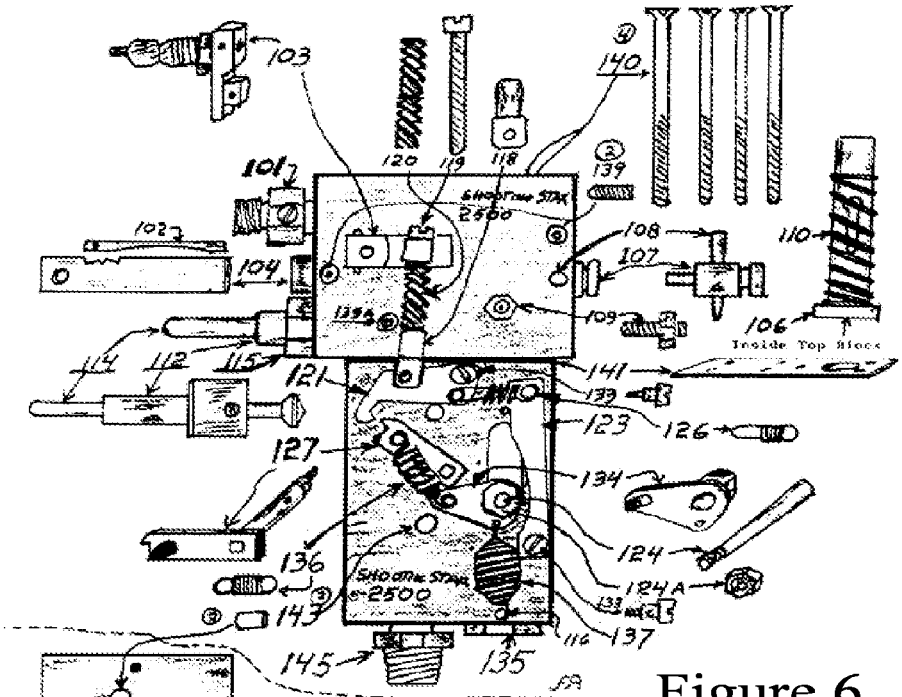
Figure 6 PRIOR ART
FIG. 6 is a side view of a PRIOR ART rapid fire air gun breech block design, showing the extreme complexity of the breech block.
Figure 7:
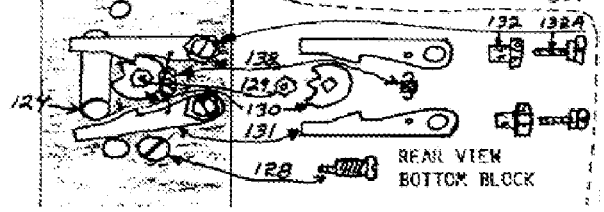
Figure 7 PRIOR ART
FIG. 7 is a back view of a PRIOR ART rapid fire gun breech block design.

Laser-sight mount 99
Air gun
Hand grip 102
Air feed line 104
Chamber 106
Frame 108
Gun barrel 110
Container/feed tube 112
First end of hand grip 114
Second end of hand grip 116
Trigger 118
First end of air feed line 120
Second end of air feed line 122
Breech end of gun barrel 124
Muzzle 126
Magazine 128
Round of ammunition 130
Staggered Round Magazine 128'
Round of ammunition 130'
First passageway 132
Valve mechanism 134
Trigger play (2 positions) 136
Chamber housing 138
Aperture 140
Interior of air feed line 142
I.D. gun barrel (barrel caliber) 144
Magnet 146
Magnetic influence (flux lines) 148
Hopper 150
Magnet 152
Ammunition feed valve 154
Feed angle 156

DETAILED DESCRIPTION OF EMBODIMENTS

For purposes of this application, "magnetic materials" refers to materials having a magnetic retentivity sufficient to allow it to generate, at least temporarily, a magnetic field, also called "magnetic flux". Magnets are themselves made of magnetic materials. Magnetically responsive materials, on the other hand, will respond when in a magnetic field, thus, steel ball bearings are an example of a magnetically responsive material. "Ferrous", on the other hand, refers to the presence of iron materials (since iron is the most common magnetic and magnetically responsive material), and the while the term is often used as a synonym for "magnetic materials" or "magnetically responsive materials", in this application it refers to the presence of iron. There are non-ferrous magnetic materials, for example, rare-earths and electromagnets can both be free of iron and yet magnetic.

The following drawings form part of the present specification and are included to further demonstrate certain aspects of the present invention. The invention may be better understood by reference to one or more of these drawings in combination with the detailed description of specific embodiments presented herein.

FIG. 1 is a side view of a first embodiment of the invention, showing overall configuration and externally visible parts. Air gun 100 has hand grip 102 which may be adapted from pressurized air equipment or specially manufactured. Hand grip 102 has two ends, one of which (first end 114) connects to a source of pressurized air and the other of which (second end 116) connects to air feed line 104. Air feed line 104 in turn has two ends (First end of air feed line 120 and second end of air feed line 122), one connected to the hand grip 102 and the other connected to chamber 106. Chamber 106 connects to the breech end of gun barrel 110.

All such connections are pneumatic, which for this context is defined to be capable of holding the pressure of air provided by the air source without significant leakage.

Frame 108 not only provides convenient handling of the weapon but furthermore provides stability to gun barrel 110, chamber 106, air feed line 104, and other components by connecting them to the relatively heavy hand grip 102. This is because most of the components can be constructed very lightly, out of thin materials such as stock aluminum, aluminum tubing and so on.

It is worth mentioning that most or all components of the weapon may be made of magnetically non-responsive materials, that is, materials which will not themselves alter or interfere with the magnet which acts as the action of the weapon.

Container/feed tube 112 also enters the chamber 106 and provides the source of the ammunition. Breech end of gun barrel 124 also enters the chamber 106, while muzzle 126 projects in the other direction.

Trigger 118 may take the traditional trigger structure or it may be a button, a lever or so on.

Feed valve 154 has two important functions. Firstly by opening the valve and either placing a magazine abutting the end of the feed tube 112 or by inserting the magazine (and possibly withdrawing it) the weapon may be quickly reloaded: testing has revealed a reload time of 20 seconds or less. However, feed valve 154 also closes off the escape of air from the feed tube 112. This is very important not just to the performance of the weapon but in order to prevent a literal back fire in which the ammunition could exit the gun from the feed tube. Feed valve 154 must thus be large enough to allow the ammunition to pass, and thus a rotary valve is favored for this component.

In embodiments of the invention, a screw cap is used as the seal over the magazine: since the magazine is generally cylindrical in favored embodiments, the screw cap embodiment is also convenient for reloading.

Angle 156 is important to operation of the gun of the invention. This angle will help determine the rate of fire of the weapon in fully automatic mode. Thus, at 90 degrees (a magazine oriented directly above the block) the maximum rate of fire is achieved. As noted previously, in one embodiment a rate of fire of almost 10,000 RPM was achieved, a figure which to the best of the inventor's knowledge may be the fastest rate of fire ever achieved for a single barrel. At approximately 45 degrees, testing has shown that fully automatic fire is achievable and yet the rate of fire is reduced to that of more typical automatic weapons. At the present time an angle of 25 degrees is preferred but any angle can be used. In fact, an angle of zero degrees works as well, in the embodiments with zero degree magazine inclination, the rounds do not gravity feed into the block and barrel and the user twitches or shakes the weapon to chamber a round.

Selection of this angle is also important in regard to the choice of ammunition caliber, that is, different calibers require different angles under some circumstances. Thus an 8 mm round might have a different magazine inclination angle than a .172 BB round if the same ROF is desired.

FIG. 2*a* is a cross-sectional side view of a straight magazine, showing rounds therein. Magazine 128 may have therein numerous rounds of ammunition 130. The principle of operation of the weapon allows the use of a wide range of sizes of rounds, provided that they are spherical and magnetically responsive. Thus .172 steel bearings have been tested, but additional sizes which can work would include ferrous based BB round (.172), other magnetic spherical rounds such as those used in antique weapons (but cast with a magnetic content rather than a non-magnetic material). This straight magazine provides a maximum muzzle velocity when compared to the magazine of FIG. 2*b*.

FIG. 2*b* is a cross-sectional side view of a staggered round magazine, showing rounds therein. Magazine 128' may have more than a single row of rounds 130' therein, or the rounds may be in a single column but staggered as shown. This embodiment is the presently preferred embodiment and best mode now contemplated, since it provides not only more rounds in a magazine but another advantage as well, having to do with air pressure.

In particular, with a straight magazine as seen in FIG. 2*a*, when air pressure from the block enters the magazine during firing, that air pressure is likely to push the rounds 130 backward up the magazine 128. This has the effect of pressure locking the rounds into place, meaning that they cannot gravity feed properly. In use, the magazine might behave normally for a first burst of fire, but then lock with the remaining rounds held away from the block by the air pressure. Obviously, the staggered rounds 130' of magazine 128' eliminate the problem by maintaining the entire magazine at a single pressure level equal to the pressure in the block.

A variant of the straight clip 130 simply uses a double-walled clip: the outer gap between the outer clip and the inner clip allows air pressure to equalize.

In one sub-embodiment of the magazine as described, the magazine was made to hold 1050 rounds of caliber .172. The magazine was approximately 14 feet long but fed properly and allowed testing of high RPM fire.

FIG. 3 is a cross-sectional side view of a hand grip of the first embodiment of the invention, showing the first passageway and valve mechanism. First passageway 132 passes through the hand grip 102, in which is disposed valve mechanism 134. The valve used may be a rotary valve, a piston valve, a needle valve, poppet, sleeve valve and so on and so forth, as only a compressible fluid (air or the like) will pass through this valve.

Trigger play with at least 2 positions (136) is shown. Note that depending on the desired use of the weapon, the trigger might control the valve to more than just open and closed positions, for example, intermediate positions and thus air flows might be possible and desirable in some applications, such as crowd control or sports.

FIG. 4 is a cross-sectionals side view of a chamber of the first embodiment of the invention, showing details thereof. Chamber housing 138 houses the chamber 106 and associated elements of the invention. Aperture 140 may be on the top side of the interior 142 of the air feed line. Note that the interior 142 diameter of the air feed line may advantageously be larger than the caliber of the weapon, if air pressure permits. Thus interior 142 may be larger, or smaller, than the internal diameter of the gun barrel (barrel caliber) 144.

Magnet 146 exerts a magnetic influence (shown by flux lines) 148 into the chamber 106. Note that magnet 146 may advantageously be a stack of small cylindrical magnets one atop the next, disposed within the lowermost of the two intersecting bores drilled through the block at right angles.

Magnet 146 may hold several BBs or shot within the barrel, resulting in a burst fire in which 6 or 8 shots are fired simultaneously. The present invention may be used with burst fire in addition to single shot and fully automatic fire.

FIG. 5 is a cross-sectional side view of a chamber of a second embodiment of the invention, showing details thereof. Hopper 150 is an alternative embodiment of the invention used to provide a much larger supply of ammunition. Magnet 152 may again be seen to be disposed at the chamber, however, it may be seen that the magnet 152 is not confined to only being disposed beneath the chamber, it may partially surround the chamber, or be located to one or both sides, etc, as the designer plans for.

It will be appreciated that while air is referred to herein, any fluid medium may be used: other gases than air, liquids including water and so on. For example, in the use of water, while the water is non-compressible, it has a much greater mass and thus is more efficient as a propellant. CO2, as commonly used in air guns, may be used, however, the small CO2 cartridges sold for the purpose are likely to provide only very low muzzle velocity and only a limited amount of firing. Thus the small CO2 cartridges are not a preferred embodiment of the invention.

Throughout this application, various publications, patents, and/or patent applications are referenced in order to more fully describe the state of the art to which this invention pertains. The disclosures of these publications, patents, and/or patent applications are herein incorporated by reference in their entireties, and for the subject matter for which they are specifically referenced in the same or a prior sentence, to the same extent as if each independent publication, patent, and/or patent application was specifically and individually indicated to be incorporated by reference.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. An air gun for use with a source of pressurized air and a plurality of rounds of magnetically responsive spherical ammunition having a caliber, the air gun comprising:

a hand grip, the source of pressurized air pneumatically connected to a first end of the hand grip, the hand grip having a first passageway therethrough from the first end of the hand grip to a second end of the hand grip, the second end of the hand grip pneumatically connected to a first end of an air feed line, the air feed line having a second passageway therethrough from the first end of the air feed line to a second end of the air feed line, the second end of the air feed line pneumatically connected to a chamber, the chamber having a breech end of a gun barrel pneumatically connected thereto, the gun barrel having a muzzle, the gun barrel, the chamber, and the first and second passageways forming a continuous air flow conduit for air from the source of pressurized air to flow to and exit from the muzzle, the breech end of the gun barrel, the chamber, and the second end of the air feed line being magnetically non-responsive materials, the chamber further having a magnet disposed at the chamber, with a magnetic influence of the magnet exerting magnetic force within the chamber, the chamber having an aperture on a top side of the chamber, the chamber yet further having a gravity feed thereto, the gravity feed disposed above the aperture, the gravity feed, the aperture, the gun barrel, and the chamber having respective inner diameters larger than the caliber, the magnetic force of the magnet over the magnetically responsive spherical ammunition to chamber a first round of the plurality of rounds without using any of a breech block, a firing pin, a coil, and a leaf spring, and the magnetic force tending to hold the first round in place in the chamber until the air pressure expels the first round from the chamber into the barrel and thence from the muzzle.

2. The air gun of claim 1, wherein the hand grip further comprises:

a trigger, the trigger attached to a valve mechanism within the first passageway, the valve mechanism and trigger having a first open position in which air from the source of pressurized air may flow through the first passageway and having a second closed position in which air from the source of pressurized air may not flow through the first passageway, the trigger further being biased into the second closed position when at rest, whereby when the trigger is pulled, the valve mechanism opens, allowing pressurized air flow through the gun from the source of pressurized air to the muzzle.

3. The air gun of claim 2, wherein the gravity feed further comprises:

a container holding a plurality of the rounds of magnetically responsive spherical ammunition, whereby when the first round is expelled by the air pressure from the chamber, a second one of the plurality of rounds of magnetically responsive spherical ammunition leaves the gravity feed and is pulled into the chamber due to the magnet, the magnet then tending to hold the second round in place in the chamber until the air pressure expels the second round from the chamber into the barrel and thence from the muzzle.

4. The air gun of claim 3, wherein the container further comprises one member selected from the group consisting of: a feed tube, a hopper, a magazine, and combinations thereof.

5. The air gun of claim 4, wherein the container comprises the feed tube, and the feed tube enters the chamber at a first angle above the horizontal, the first angle being in the range from 0 to 90 degrees.

6. The air gun of claim 5, wherein the magnet is disposed below the chamber.

7. The air gun of claim 6, wherein the magnet is one member selected from the group consisting of: a ferrous magnet, a rare-earth magnet, an electromagnet, and combinations thereof.

8. The air gun of claim 7, further comprising:

a frame, the frame having a first frame member supporting the gun barrel, the chamber, and the air feed line, the first frame member secured to the hand grip.

9. The air gun of claim 5 wherein the container holds the first and second rounds in a staggered arrangement.

10. The air gun of claim 1, wherein the plurality of rounds of magnetically responsive spherical ammunition further comprise one member selected from the group consisting of: steel ball bearings, shot, BB ammunition, and combinations thereof.

11. The air gun of claim 1, wherein the caliber is .172" (4.37 mm).

12. The air gun of claim 11, wherein the gun barrel has an inner diameter of 0.187" (4.75 mm).

13. The air gun of claim 1, wherein the source of pressurized air provides the pressurized air in a range from 95 to 120 psi (655 KPa to 827 KPa).

14. The air gun of claim 1, wherein the caliber is one member selected from the group consisting of: 9.6 mm, 8 mm, and 5.5 mm.

* * * * *